United States Patent [19]

Antezana

[11] Patent Number: 5,003,833

[45] Date of Patent: Apr. 2, 1991

[54] GYRATING DRIVE FOR PARTICLE SCREENING MACHINE

[76] Inventor: Luis F. Antezana, P.O. Box 1419, Mercer Island, Wash. 98040

[21] Appl. No.: 512,548

[22] Filed: Apr. 23, 1990

Related U.S. Application Data

[63] Continuation-in-part of Ser. No. 386,958, Jul. 28, 1989, abandoned.

[51] Int. Cl.[5] ..... B07B 1/28

[52] U.S. Cl. ..... 74/87; 209/366.5

[58] Field of Search ..... 74/61, 87; 209/366.5, 209/367; 366/128

[56] References Cited

U.S. PATENT DOCUMENTS

| | | | |
|---|---|---|---|
| 1,100,149 | 6/1914 | Prokop | 209/366.5 |
| 2,313,765 | 3/1943 | Parks | 209/366.5 X |
| 2,664,201 | 12/1953 | Dunn | 209/366.5 X |
| 2,751,080 | 6/1956 | Gleiser | 209/366.5 X |
| 3,468,418 | 9/1969 | Renner | 74/87 X |
| 3,727,470 | 4/1973 | Choules | 209/366.5 X |
| 4,270,396 | 6/1981 | Fallows | 74/87 |
| 4,308,758 | 1/1982 | Humphrey | 74/87 |
| 4,472,980 | 9/1984 | Wadensten | 74/61 |

FOREIGN PATENT DOCUMENTS

| | | | |
|---|---|---|---|
| 1031729 | 5/1978 | Canada | 209/366.5 |
| 256499 | 2/1949 | Switzerland | 209/366.5 |
| 477949 | 12/1937 | United Kingdom | 209/367 |

OTHER PUBLICATIONS

Kone Chip Screens brochure, Konewood, a divisoin of Kone Corp., SF-15870, Salpakangas, Finland.

Forano brochure-(Super Chip Screen)-1600, St-Paul Street, Plessisville (Quebec) Canada G6L 2Y9.

BM&M brochure-Burnaby Machine Mill Equipment Ltd., 7570 Conrad St. Burnaby, B.C., Canada VSA 2H7.

*Primary Examiner*—Allan D. Herrmann

*Attorney, Agent, or Firm*—Jackson & Richardson

[57] ABSTRACT

A drive for a particle screening machine or the like in which a bearing support plate is attached to two side walls of the screening machine. A stationary bearing hub is mounted on the support plate in registration with an opening through the plate, and the hub receives and supports a bearing assembly which in turn journals a rotatably driven shaft. A pair of weights are positioned on opposite sides of the stationary support plate and are eccentrically mounted adjacent opposite ends of the shaft with their centers of mass equidistant from the geometric center of the rotatable shaft. The two weights are aligned such that an axis passing through the mass centers of the weights is parallel to the longitudinal axis of the shaft.

10 Claims, 4 Drawing Sheets

GYRATING DRIVE FOR PARTICLE SCREENING MACHINE

This application is a continuation-in-part of application Ser. No. 07/386,958, filed July 28, 1989, now abandoned, the benefit of the filing dates of which are hereby claimed under 35 USC 120.

BACKGROUND OF THE INVENTION

The present invention pertains to a drive for screening machines which sort objects. Specifically, the present invention relates to a drive for use in a machine, known as a mass particle screening machine, for separating material based on particle size. The screening machine is essentially a box having trays of sloping screen plates with varying size mesh openings. A drive having a rotating eccentric weight gyrates the screening box, thus causing the particles to pass through one screen to another screen sorting the particles by specific size.

Examples of known drive units for chip screening machines include U.S. Pat. No. 4,308,758, issued to Humphrey, which discloses a drive box having a fixed shaft and a single rotating eccentric weight fixed to a rotating bearing assembly.

Another drive unit manufactured by KONE WOOD of Salpakangas, Finland, has split weight on a rotating shaft. The split weights of the KONE WOOD invention are located above and below the chip screening machine and are connected by a shaft which passes through the screens of the machine. This shaft arrangement in the KONE WOOD machine impedes and obstructs the horizontal flow of wood chips on the various screens.

A drive unit manufactured by Forano teaches a single weight connected directly to a rotating shaft. The Forano drive unit requires precise machining of the shaft and bearing assembly due to the fact that it employs a single weight rotating with the shaft. Specifically, the bearing housings must be machined concentrically, the bearings must be precisely aligned, and the shaft must be plumb. Unlike the present invention, screening machines with these types of drives often suffer structural failure by operation at high levels of weight revolution 200 RPM or more) if the drives are not manufactured properly.

A drive unit manufactured by CAE Machinery, Ltd., teaches a single weight connected directly to an upstanding and rotating shaft allowing the weight controid to be colinear with the shaft, bearing, and screening machine centroid of mass. The bearing housing hub flange is bolted onto a base plate and the shaft is extended or cantilevered out of the housing. This drive may induce structural distortion and eventual fatigue failure of key components on the screening machine if improperly designed. The proper design will require substantially heavier componentry to make it safe. The present invention requires only 1/6 to ⅓ of those weight requirements.

Drives disclosed in U.S. Pat. No. 4,472,980 issued to Wadensten and in U.S. Pat. No. 4,270,396 issued to Fallows both require complete, structurally integral housing entirely surrounding the drive to provide the necessary structural support to prevent undesired drive motion, vibrations, and main frame distortions. These bulky, heavy housings require the use of larger weights (2000 lbs total) in these inventions than those of the present invention (preferably approximately 700 lbs total) to produce the desired amount of force necessary to move the housing and unit as a whole. Thus, these references also require larger, more expensive motors to power the larger weights. The larger housings also necessitate that the drives take up a larger interior area of the particle screening machine than the present invention. Specifically, the height of the average particle screening machine having 200 square feet of screens per deck must be increased from the industry standard of about 3 feet to between 5 and 6 feet to allow placement of the bulky housing between the particle screens. The heavy drive housing, larger drive heights and drive motor, and deeper particle screening machine required by the prior art produce a particle screening machine and drive weighing between 20,000 and 30,000 pounds as opposed to the approximately 10,000 pound total weight drive and particle screening machine of the present invention. Importantly, the prior art drives, due to the above mass and height requirements of their housings, cannot function in a particle screening machine having a height of approximately 3 feet and 200 square feet of screen per deck. The prior art drives, to operate in a particle screening machine having 200 square feet of screen per deck, would require a drive shaft and associated weights about 18 inches in height, external housing covers located 6 to 10 inches above and below the weights, a drive coupling 6 to 8 inches long attaching the shaft to a motor, and a motor 12 to 24 inches in height. Thus, the overall height of the drive of the prior art is between 42 inches and 70 inches, as opposed to the approximately 12 inch to 16 inch height of the present invention. The above factors make the Wadensten and Fallows drives impractical for horizontal screening machines.

The above noted deficiencies of prior equipment are overcome in the present invention by a drive for a low profile particle screening machine of approximateldy 3 feet in height constructed to operate reliably at speeds above 250 RPM and pass particles freely in a practical, compact and convenient to operate and repair configuration.

SUMMARY OF THE INVENTION

This invention can be broadly summarized as a drive for a low profile (approximately 3 feet in height) particle screening machine having split weights attached to a rotatable shaft. The drive includes a stationary bearing support plate attached to the particle screening machine side walls and having an opening in which a hollow hub is fixedly attached. A bearing assembly is mounted in the hub concentric with the opening. The bearing assembly includes a stationary bearing race which is connected to the hub, bearings, and a rotatable race mounted on a rotatable shaft passing coaxially through the bearing assembly. On each end of the rotatable shaft is a radially projecting arm and mounted on each of these arms is a weight. These weights are shaped and positioned eccentrically with respect to the shaft and hub. The centers of mass of these weights are equidistant from the geometric center (with respect to both the diameter and length) of the rotatable shaft such that the drive unit operates reliably at high speeds of at least approximately 200 RPMs for extended periods. A driving means rotates the rotatable shaft and associated weights to impart substantially horizontal planar gyrational motion through the bearing support plate to the side walls of the particle screening machine, which imparts this gyrational motion to the particle screening machine as a whole, and specifically to the screen sorting trays. The bearing support plate, two side walls, and two long span stiffener plates provide the structural integrity necessary to maintain the above planar gyrational motion of the drive unit. A completely enclosed and structurally integral housing is not required to prevent undesired drive unit motions and associated distortions. Specifically, top and/or bottom housing covers are not needed for structural integrity of the drive. All of the above drive unit elements, including the shaft, are enclosed within the particle screening machine to form a compact drive unit sized and arranged so as to not impede the horizontal flow of particles through the sorting screens.

According to more detailed aspects of the preferred embodiment of the invention, the bearings are tapered cylinder bearings; the weights are aligned such that an axis intersecting their centers of mass is parallel to the axis of the shaft; the shaft is oriented perpendicularly to the support plate; and the geometric axis of the rotatable shaft intersects the geometric center of the chip screening machine.

DESCRIPTION OF THE PREFERRED EMBODIMENT

Figure 1:
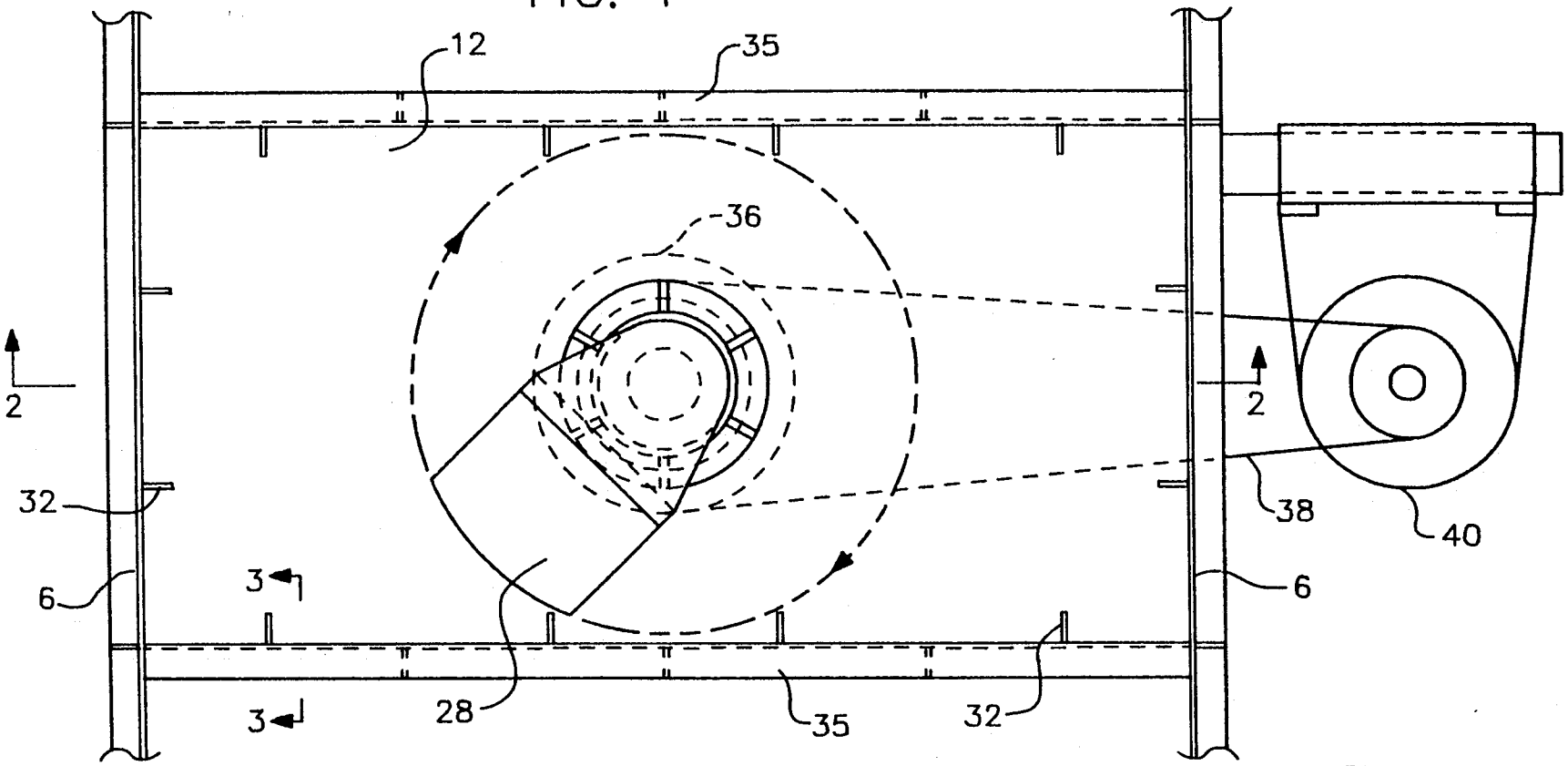
FIG. 1 is a plan view of the drive unit.
Figure 3:
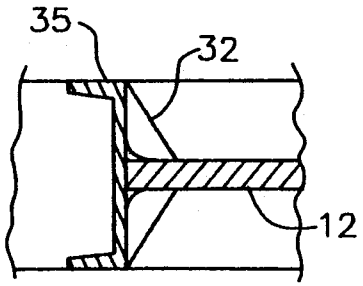
FIG. 3 is a cross-sectional view of a portion of the drive unit taken along line 3—3 of FIG. 1.
Figure 2:
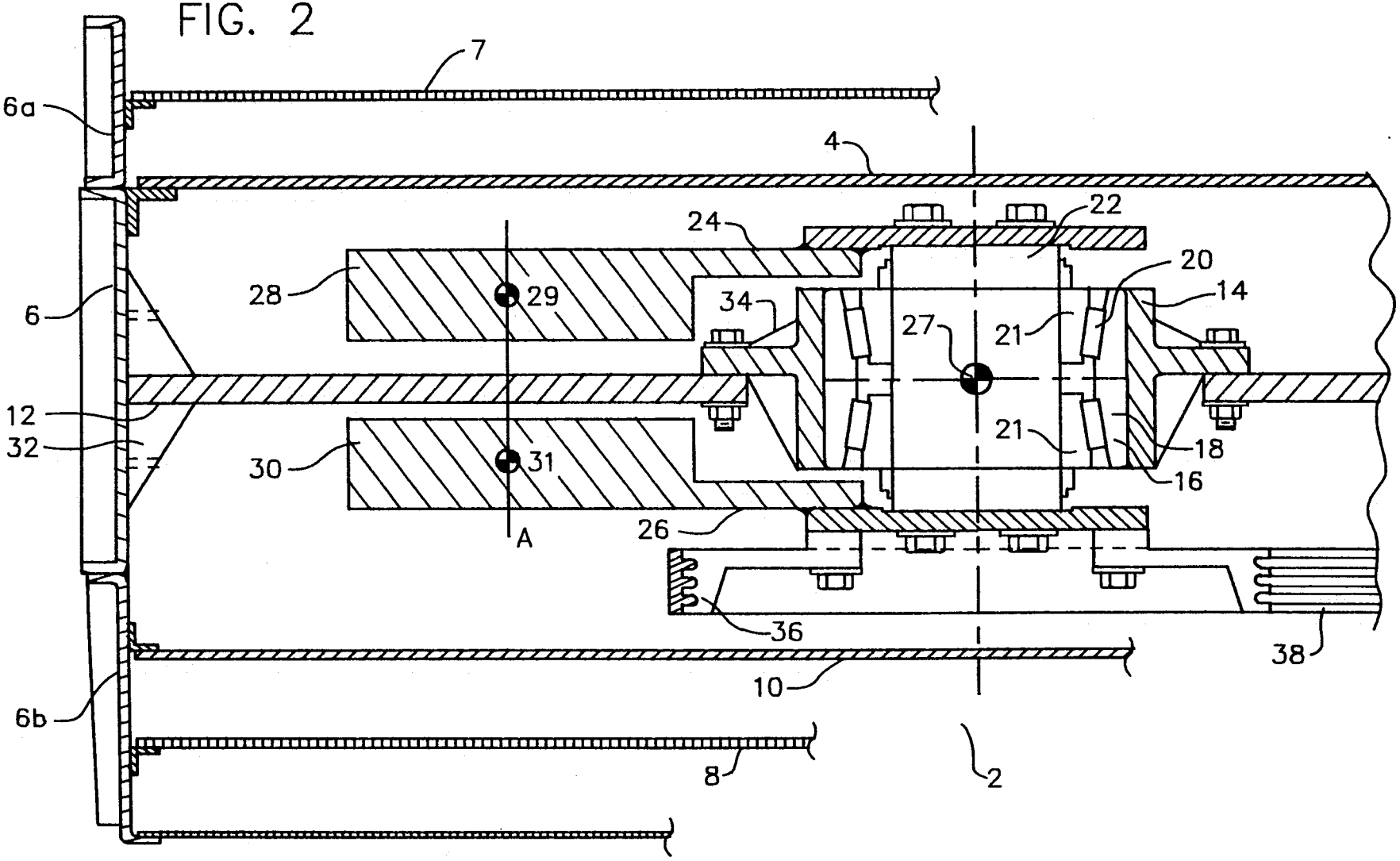
FIG. 2 is a cross sectional view of the drive unit for a particle screening machine constructed in accordance with the preferred embodiment of the invention taken along line 2—2 of FIG. 1.

Referring to FIGS. 1, 2 and 3, the drive 2, at bearing support plate 12, is connected to two opposite side walls 6 of the particle screening machine. It is a key feature of the present invention that drive 2 functions in a particle screening machine having 200 square feet of screen area per deck and having a height, as defined by side walls 6 and any additional walls attached to side walls 6, of approximately 3 feet. Approximately 3 feet is defined as being between 28 and 40 inches. However, drive 2 can also function in particle screening machines having greater or lesser screen area and/or height (and thus different overall dimensions) than stated above. It is understood that when drive 2 is used in such particle screening machines, the mass, dimensions and power requirements of drive 2 can be modified accordingly.

Optionally, top drive cover 4 and bottom drive cover 10 may be included in drive 2. However, top drive cover 4 and bottom drive cover 10 are not required for the structural integrity of the drive 2, and are only present to protect drive 2 from dirt and chip dust. Top drive cover 4 and bottom drive cover 10 are preferably removably bolted onto side walls 6 for ease of drive cleaning and repair. Attached to side walls 6 is stationary bearing support plate 12 which divides the drive 2 into first and second chambers. Attachment of support plate 12 to side walls 6 is preferably with bolts or welding. In a preferred embodiment, stationary bearing support plate 12 is substantially orthogonal with respect to side walls 6. Bearing support plate 12, side walls 6, and optionally long span stiffener plates or walls 35, which are perpendicular to side walls 6, alone provide the structural integrity necessary to maintain substantially horizontal planar gyrational motion of the drive 2 and to prevent undesired drive motion and associated vibrations and main frame distortions which may cause structural failure throughout the drive and the screening machine. Also attached to side walls 6, preferably with bolts or the like, are side extension walls 6*a* and 6*b* which hold chip screens 7 and 8. As stated above, the overall height of the particle screening machine containing the drive 2 of the present invention is between 28 and 40 inches, or approximately 3 feet.

Stationary bearing support plate 12 includes an opening in which hollow stationary hub 14 is mounted. Bearing assembly 16 is mounted in stationary hub 14, concentric with the opening.

Bearing assembly 16 includes a stationary bearing race 18, which secures bearing assembly 16 to stationary hub 14, and a plurality of bearings 20. These bearings 20 are preferably of a type known as A-P bearings, which are tapered cylinder bearings designed for heavy duty applications. In a preferred embodiment, bearings 20 form two annular rings, one above the other, in bearing assembly 16. Bearing assembly 16 also includes an opening and rotatable bearing races 21 which are mounted on a rotatable shaft 22. Rotatable shaft 22 passes coaxially through the opening of bearing assembly 16 such that rotatable races 21 communicate with bearings 20. The longitudinal axis of rotatable shaft 22 is perpendicular to support plate 12.

Attached to the top end and the bottom end of rotatable shaft 22 are radially projecting arms 24 and 26, respectively. Weights 28 and 30 are mounted on arms 24 and 26, respectively, and are of proportionally less mass than the mass of the particle screening machine. Specifically, weights 28 and 30 can weigh from 10 to 1000 pounds each with a preferred total weight of about 700 pounds, depending on the size of the screening machine. Weights 28 and 30 may be placed at varying distances from shaft 22 by varying the length of arms 24 and 26 in order to increase or decrease the gyration characteristics of the drive. Weights 28 and 30 are preferably of equal size, shape and mass.

Weights 28 and 30 are shaped and positioned eccentrically with respect to shaft 22 and hub 14. Weights 28 and 30 have mass centers 29 and 31, respectively. These mass centers 29 are equidistant from the geometric center 27 of shaft 22. The geometric center 27 is to be understood as the center of shaft 22 with respect to both the length and the diameter of shaft 22. Also, weights 28 and 30 are aligned such that a mass axis A intersecting both mass center 29 and mass center 31 is parallel to the longitudinal axis of shaft 22. The above alignment of weights 28 and 30 prevents the transfer of asymmetric forces from weights 28 and 30 to shaft 22 during rotation which would destabilize the screening machine at 200 RPM or more. The use of two symmetric weights, 28 and 30, as opposed to a single weight, provides an eccentric weight rotor without asymmetric force tendencies. In order to prevent assymetric gyrational drive forces at levels above 200 RPM, more precise tolerances are required in the alignment of the center of mass of a single weight with the shaft's geometric center when compared to the alignment of the centers of mass of two split weights with the shaft's geometric center.

The overall height of shaft 22 and attached weights 28 and 30, and thus drive 2 as a whole, is between 12 inches and 16 inches, thus allowing drive 2 to be employed in a standard particle screening machine of approximately 3 feet in height (28 to 40 inches), and having 200 square feet of screen area per deck.

While stationary bearing support plate 12 may be aligned such that its center of mass is not in the same plane as geometric center 27 of shaft 22, stationary bearing support plate 12 is aligned perpendicularly to the longitudinal axis of shaft 22.

Radial stiffeners 32 are connected to slide walls 6 of the chip screening machine and support plate 12. As shown in FIG. 3, some of radial stiffeners 32 are instead connected to long span stiffener plates 35 and to support plate 12. Radial stiffeners 34 are connected to stationary hub 14 and support plate 12. Radial stiffeners 32 and 34 provide structural support for the elements to which they are attached and aid in transfer of gyrational forces from weights 28 and 30 to support plate 12 and side walls 6.

Figure 5:
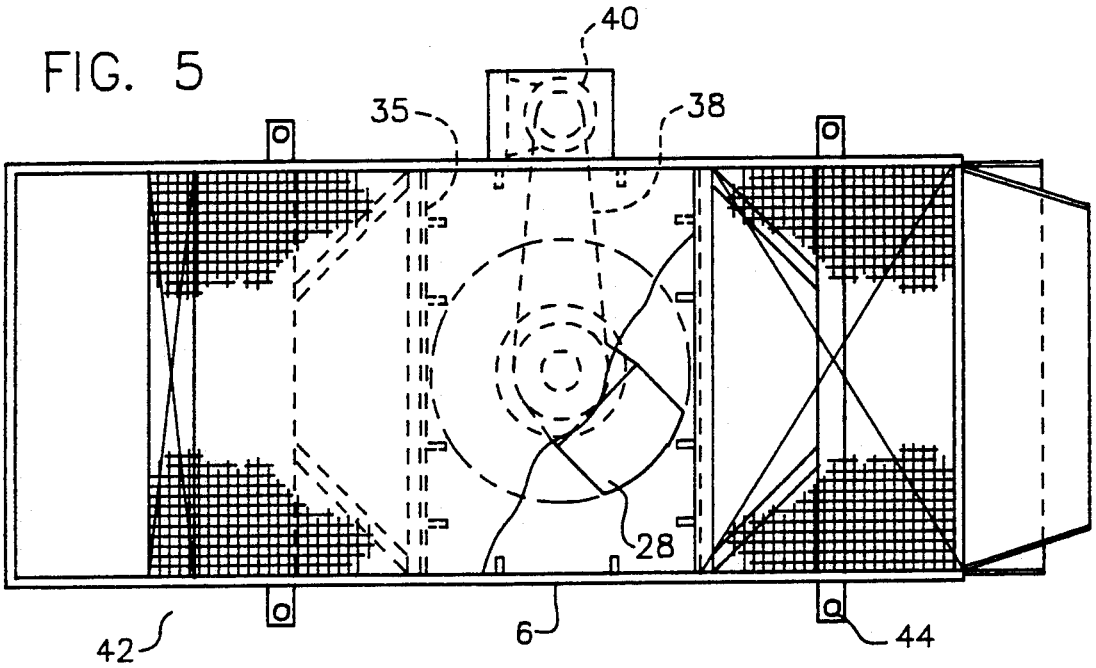
FIG. 5 is a plan view of the drive unit within a particle screening machine.

Now referring to FIGS. 1, 2 and 5, a pulley 36 is connected to an end of shaft 22, preferably the bottom end of shaft 22. Connected to pulley 36 is drive belt 38. Drive belt 38 is also connected to drive motor 40 which powers drive 2 via drive belt 38 and pulley 36. Note that, in the preferred embodiment, the drive system is not enclosed by optional bottom wall 10 or by any chip screens. Thus, the drive system is easily accessible for repair and maintenance.

Figure 4:
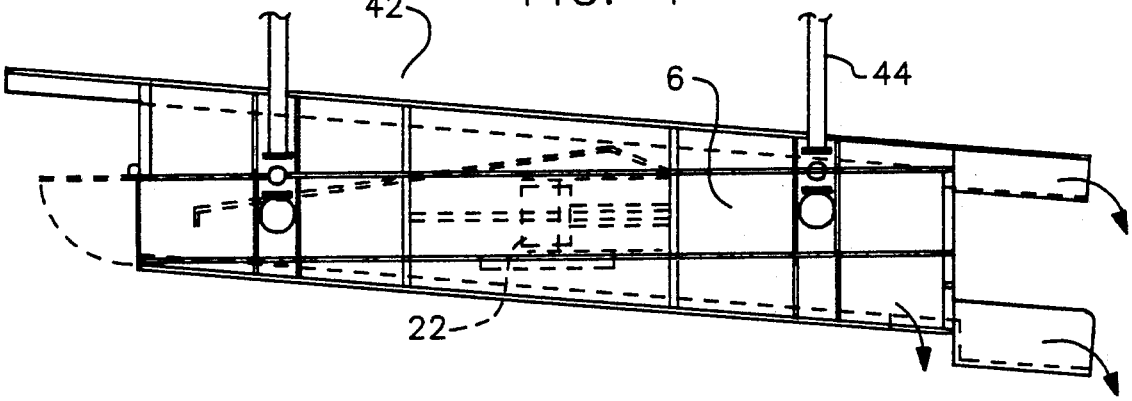
FIG. 4 is an elevation view of the drive unit in a screening machine.
Figure 6:
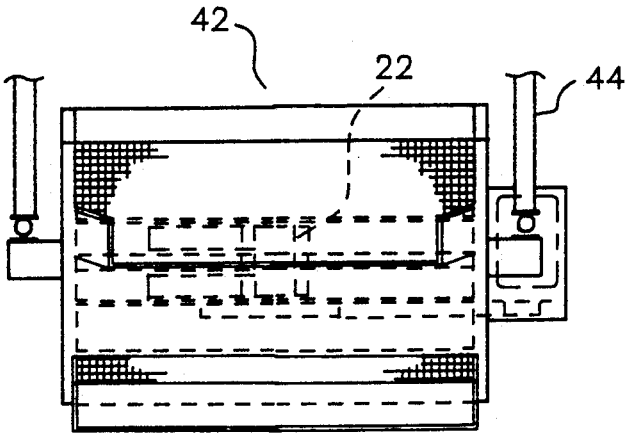
FIG. 6 is a front elevation view of the drive unit within a particle screening machine.
Figure 7:
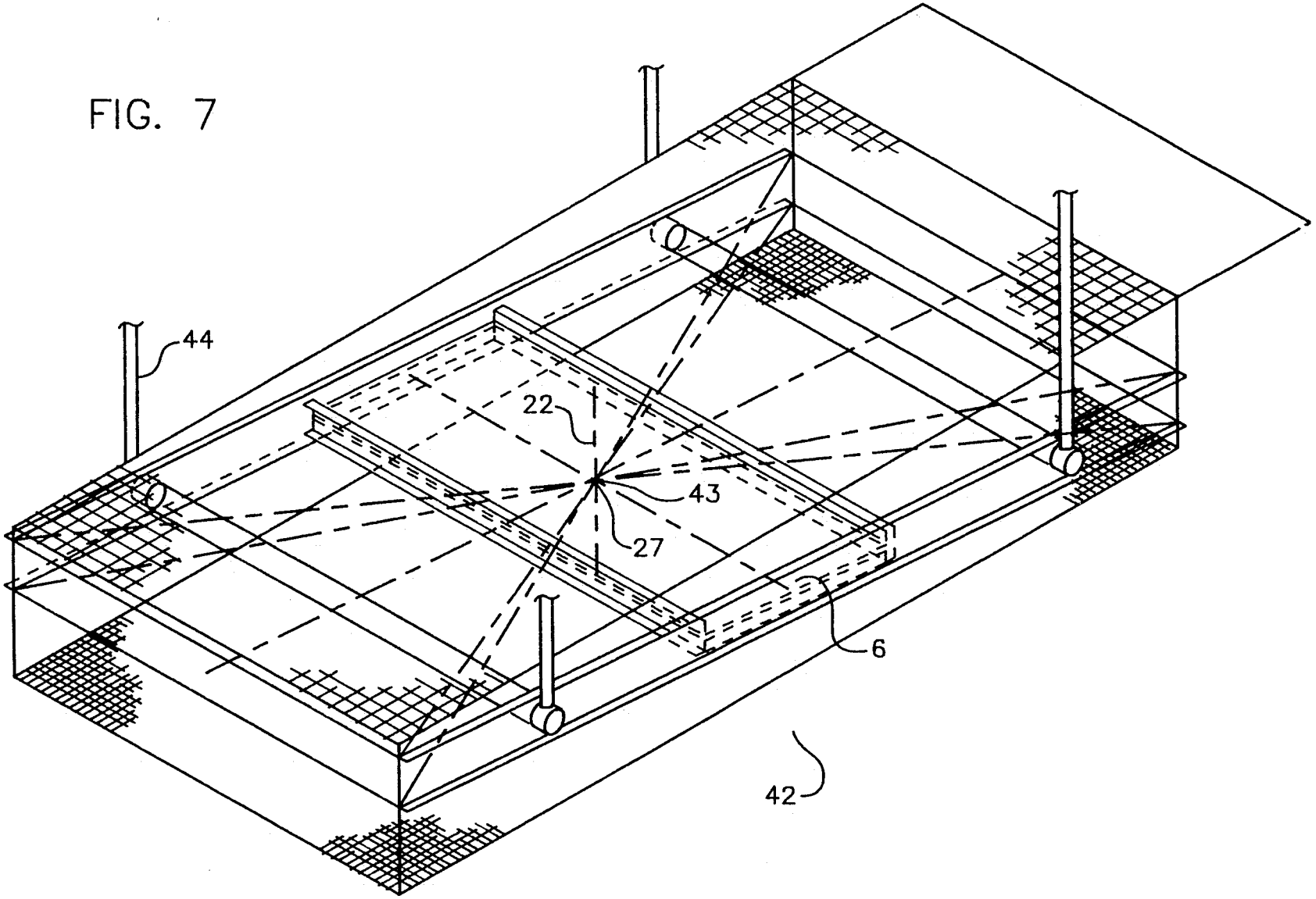
FIG. 7 is a perspective view of the drive unit within a particle screening machine.

Referring now to FIGS. 4, 6 and 7, note that drive 2, in its entirety, is contained within the confines of screening machine 42. Thus, no horizontal component of drive 2 physically obstructs the flow of particles over the screen levels of screening machine 42. In a preferred embodiment, drive 2 is positioned within screening machine 42 such that the geometric center 27 of shaft 22 intersects the geometric center of screening machine 42. In the most preferred embodiment, the geometric center 27 of shaft 22 intersects the geometric center of drive 2, and both of these geometric centers intersect the geometric center 43 of screening machine 42.

In operation, drive motor 40 powers drive 2 via drive belt 38 and pulley 36. Rotatable shaft 22 rotates weights 28 and 30, preferably at a speed of at least approximately 200 revolutions per minute. The eccentric orientation of weight 28 and 30 with respect to shaft 22 and stationary hub 14 provides centrifugal force which is imparted along arms 24 and 26 to shaft 22. This centrifugal force causes substantially horizontal planar gyrational motion of drive 2, including radial stiffeners 34, stationary bearing support plate 12 and radial stiffeners 32. This force is transferred by bearing support plate 12 and radial stiffeners 32 to side walls 6 and long span stiffener plates 35. The substantially horizontal planar gyrational motion is imparted to screening machine 42, as a whole, thereby agitating the particles and causing the particles to pass through the screens 7 and 8 of screening machine 42. Screening machine 42 is preferably suspended above ground by hangers 44 which are preferably cables or rods having U-joint assemblies.

While particular embodiments of the invention have been described above, changes and modifictions may be made in the illustrated embodiments without departing from the spirit or form of the invention. It is therefore intended that the following claims cover all equivalent modifications and variations which fall within the scope of the invention as defined by the claims.

I claim:

1. A drive imparting substantially horizontal planar gyrational motion for a particle screening machine having at least two side walls, said drive comprising:

a stationary bearing support plate attached to the side walls, said stationary bearing support plate having an opening therein, said stationary support plate and said walls providing structural integrity of said drive during said gyrational motion of said drive;

a stationary hub fixedly mounted to said support plate in registration with said opening;

a bearing assembly mounted in said hub, said bearing assembly including bearings, a rotatable bearing race, and a stationary bearing race;

a rotatable shaft having a first end, a second end and a longitudinal axis, said rotatable shaft journalled for rotation in said bearing assembly and contacting said rotatable bearing race;

a first weight supporting arm connected to said shaft adjacent said first end of said shaft and a second weight supporting arm connected to said shaft adjacent said second end;

a first weight arranged within the particle screening machine and connected to said first arm and a second weight arranged within the particle screening machine and connected to said second arm, said first and second weight positioned eccentrically with respect to said longitudinal axis of said shaft and rotating therewith in said housing; and a driving means coupled to said rotatable shaft whereby rotation of said shaft and of said weights imparts gyrational motion to said drive.

2. The drive of claim 1 wherein said stationary support plate is substantially orthogonal to the side walls.

3. The drive of claim 1 wherein said particle screening machine has a geometric center and said shaft has a geometric center, said geometric center of said shaft intersecting said geometric center of said particle screening machine.

4. The drive of claim 1 wherein said drive is contained within a particle screening machine having a height of approximately 3 feet.

5. The drive of claim 1 wherein the total mass of said first weight and said second weight is approximately 700 pounds.

6. The drive of claim 1 wherein said weights rotate at a rate of at least approximately 200 revolutions per minute.

7. The drive of claim 1 further comprising:

a pair of support walls perpendicular to the particle screening machine side walls attached to said stationary bearing support plate and providing structural integrity of said drive during said gyrational motion of said drive.

8. The drive of claim 1 wherein the height of said drive as measured from said first weight to said second weight and along said rotatable shaft is between 12 and 16 inches.

9. A drive imparting substantially horizontal planar gyrational motion for a particle screening machine having at least two walls, said drive comprising:

a bearing support plate attached to the walls so as to separate said drive into first and second portions, said bearing support plate and the walls providing structural integrity of said drive during gyrational motion of said drive;

bearing means fixedly mounted on said bearing support plate;

first and second weights arranged respectively within said first and second portions;

shaft means for rotating in said bearing means, and said first and second weights eccentrically attached to said shaft means so as to impart gyrational motion to the particle screening machine upon rotation of said shaft means and said first and second weight within said housing; and a driving means coupled to said shaft.

10. A drive imparting substantially horizontal planar gyrational motion for a particle screening machine having at least two side walls, said drive comprising:

a stationary bearing support plate disposed substantially orthogonally to the side walls, said stationary support plate having an opening therein, said stationary support plate and the side walls providing structural integrity of said drive during said gyrational motion of said drive;

a stationary hub fixedly mounted to said support plate in registration with said opening;

a bearing assembly mounted in said hub, said bearing assembly including bearings, a rotatable bearing race, a stationary bearing race;

a rotatable shaft having a first end, a second end and a longitudinal axis, said rotatable shaft journalled for rotation in said bearing assembly and contacting said rotatable bearing race, said shaft disposed perpendicularly to said bearing assembly support plate;

a first weight supporting arm connected to said shaft adjacent said first end of said shaft and a second weight supporting arm connected to said shaft adjacent said second end of said shaft, said first arm and said second arm disposed on opposite sides of said stationary support plate;

a first weight arranged within the particle screening machine and connected to said first arm and a second weight arranged within the particle screening machine and connected to said second arm, said first weight and said second weight having mass centers, said shaft having a geometric center, said mass centers being equidistant from said geometric center of said shaft, said first weight and said second weight aligned such that a mass axis intersecting said mass centers is parallel to said longitudinal axis of said shaft, said first weight and said second weight positioned eccentrically with respect to said longitudinal axis of said shaft and rotating therewith in said housing; and a driving means coupled to said rotatable shaft whereby rotation of said shaft and of said weights imparts gyrational motion to said drive.

* * * * *